US009416495B2

(12) United States Patent
Depres et al.

(10) Patent No.: US 9,416,495 B2
(45) Date of Patent: Aug. 16, 2016

(54) PRINTABLE SHEET THAT IS ULTRA-SMOOTH AND RECYCLABLE, AND ITS METHOD OF FABRICATION

(75) Inventors: Gael Depres, Chirens (FR); Jean-Marie Vau, Paris (FR)

(73) Assignee: ARJO WIGGINS FINE PAPERS LIMITED, Manchester (GB)

( * ) Notice: Subject to any disclaimer, the term of this patent is extended or adjusted under 35 U.S.C. 154(b) by 0 days.

(21) Appl. No.: 13/515,471

(22) PCT Filed: Dec. 22, 2010

(86) PCT No.: PCT/FR2010/052879

§ 371 (c)(1),
(2), (4) Date: Aug. 17, 2012

(87) PCT Pub. No.: WO2011/077048

PCT Pub. Date: Jun. 30, 2011

(65) Prior Publication Data

US 2012/0308744 A1 Dec. 6, 2012

(30) Foreign Application Priority Data

Dec. 23, 2009 (FR) ..... 09 06325

(51) Int. Cl.
*B44C 1/165* (2006.01)
*B44C 1/17* (2006.01)
(Continued)

(52) U.S. Cl.
CPC ..... *D21H 27/22* (2013.01); *B41M 5/52* (2013.01); *D21H 19/00* (2013.01); *D21H 19/36* (2013.01); *D21H 19/66* (2013.01); *D21H 19/80* (2013.01); *D21H 23/10* (2013.01); *D21H 23/22* (2013.01); *D21H 23/66* (2013.01); *D21H 23/70* (2013.01);
(Continued)

(58) Field of Classification Search
CPC ..... D21H 27/22
USPC ..... 156/230–232, 235, 241, 247, 249, 277; 428/32.18, 32.2, 32.21, 32.39
See application file for complete search history.

(56) References Cited

U.S. PATENT DOCUMENTS 4,292,397 A 9/1981 Takeuchi et al.
4,349,402 A 9/1982 Parker
(Continued)

FOREIGN PATENT DOCUMENTS

DE 2747241 A1 4/1979
DE 69207751 T2 2/1997
(Continued)

OTHER PUBLICATIONS

English Abstract of JP 07-156,532 (Jul. 22, 2014).*
(Continued)

*Primary Examiner* — Sing P Chan
(74) *Attorney, Agent, or Firm* — Westerman, Hattori, Daniels & Adrian, LLP

(57) ABSTRACT

A method of fabricating a smooth or ultra-smooth printable sheet, the method comprising the steps consisting in: preparing a multilayer structure (12) having at least one bottom plastics film (14), one anti-adhesive intermediate layer (16), and one printable top layer (18), pasting one face (30) of a substrate (24) or the top face (28) of the printable layer, and applying the substrate onto the printable layer in order to laminate them together, then withdrawing the plastics film from the printable layer, the printable layer (18) defining a smooth or ultra-smooth face (22) on the sheet.

33 Claims, 2 Drawing Sheets

(51) Int. Cl.

| | |
|---|---|
| ***B29C 37/00*** | (2006.01) |
| ***B29C 65/48*** | (2006.01) |
| ***B32B 37/12*** | (2006.01) |
| ***B32B 37/14*** | (2006.01) |
| ***B32B 37/26*** | (2006.01) |
| ***B32B 38/10*** | (2006.01) |
| ***B32B 38/14*** | (2006.01) |
| ***B41M 5/025*** | (2006.01) |
| ***B41M 5/50*** | (2006.01) |
| ***B41M 5/52*** | (2006.01) |
| ***D21H 27/22*** | (2006.01) |
| ***D21H 19/00*** | (2006.01) |
| ***D21H 19/36*** | (2006.01) |
| ***D21H 19/66*** | (2006.01) |
| ***D21H 19/80*** | (2006.01) |
| ***D21H 23/10*** | (2006.01) |
| ***D21H 23/22*** | (2006.01) |
| ***D21H 23/66*** | (2006.01) |
| ***D21H 23/70*** | (2006.01) |
| ***D21H 23/72*** | (2006.01) |
| ***D21H 27/00*** | (2006.01) |

(52) U.S. Cl.

CPC ..... *D21H 23/72* (2013.01); *D21H 27/001* (2013.01); *D21H 27/004* (2013.01); *Y10T 29/49117* (2015.01); *Y10T 428/24355* (2015.01)

(56) References Cited

U.S. PATENT DOCUMENTS

| | | | | |
|---|---|---|---|---|
| 4,733,247 | A | 3/1988 | Arai et al. | |
| 4,867,844 | A | 9/1989 | Dessauer | |
| 5,256,621 | A | 10/1993 | Yasuda et al. | |
| 5,356,853 | A | 10/1994 | Saito et al. | |
| 5,593,939 | A | 1/1997 | Saito et al. | |
| 5,726,122 | A | 3/1998 | Saito et al. | |
| 5,985,425 | A | 11/1999 | Tomizawa et al. | |
| 6,177,187 | B1 | 1/2001 | Niemoller et al. | |
| 6,215,508 | B1 * | 4/2001 | Bryan et al. | 347/171 |
| 6,280,827 | B1 * | 8/2001 | Kume et al. | 428/32.39 |
| 6,358,660 | B1 * | 3/2002 | Agler et al. | 430/125.32 |
| 6,410,097 | B2 * | 6/2002 | Kume et al. | 427/387 |
| 6,450,633 | B1 | 9/2002 | Kronzer | |
| 6,497,781 | B1 * | 12/2002 | Dalvey et al. | 156/234 |
| 6,513,434 | B1 | 2/2003 | Nakazawa et al. | |
| 7,189,676 | B2 * | 3/2007 | Bourdelais et al. | 503/227 |
| 2001/0009696 | A1 * | 7/2001 | Kume et al. | 427/387 |
| 2002/0006869 | A1 * | 1/2002 | Tajiri et al. | 503/216 |
| 2002/0022118 | A1 | 2/2002 | Sarkar et al. | |
| 2003/0017321 | A1 | 1/2003 | Iwasa et al. | |
| 2003/0137579 | A1 | 7/2003 | Tamura et al. | |
| 2003/0224150 | A1 | 12/2003 | Ludwig et al. | |
| 2005/0167035 | A1 | 8/2005 | Laskey et al. | |
| 2006/0055169 | A1 | 3/2006 | Reinhart | |
| 2006/0073417 | A1 | 4/2006 | Hermesdorf | |
| 2008/0036197 | A1 | 2/2008 | Brehm et al. | |
| 2008/0187651 | A1 | 8/2008 | Lee et al. | |
| 2008/0264682 | A1 | 10/2008 | Catron et al. | |
| 2009/0008028 | A1 | 1/2009 | Reschke et al. | |
| 2009/0061159 | A1 | 3/2009 | Staub et al. | |
| 2009/0233015 | A1 | 9/2009 | Fujimoto et al. | |
| 2009/0301649 | A1 | 12/2009 | Augsberg et al. | |
| 2010/0078208 | A1 | 4/2010 | Inoue | |
| 2011/0079344 | A1 | 4/2011 | Sheu | |
| 2014/0290520 | A1 | 10/2014 | Frenkel et al. | |

FOREIGN PATENT DOCUMENTS

| | | | | | |
|---|---|---|---|---|---|
| DE | 19628341 | A1 | | 1/1998 | |
| EP | 0038878 | A1 | | 11/1981 | |
| EP | 0062967 | A2 | | 10/1982 | |
| EP | 0 454 428 | A1 | | 10/1991 | |
| EP | 0 474 494 | A2 | | 3/1992 | |
| EP | 0474494 | A2 | | 3/1992 | |
| EP | 1035504 | A1 | | 9/2000 | |
| EP | 1584647 | A1 | | 10/2005 | |
| EP | 2 045 090 | A1 | | 4/2009 | |
| EP | 2045090 | A1 | | 4/2009 | |
| GB | 2006109 | A | | 5/1979 | |
| JP | S61-290085 | A | | 12/1986 | |
| JP | S62-211195 | A | | 9/1987 | |
| JP | H04-363292 | A | | 12/1992 | |
| JP | H06-297865 | A | | 10/1994 | |
| JP | 07-156532 | A | | 6/1995 | |
| JP | 07156532 | A | * | 6/1995 | B41M 3/12 |
| JP | H10-250245 | A | | 9/1998 | |
| JP | 2000-001097 | A | | 1/2000 | |
| JP | 2006-026522 | A | | 2/2006 | |
| TW | 200950607 | A | | 12/2009 | |
| WO | 93/16888 | A1 | | 9/1993 | |
| WO | 03/020519 | A1 | | 3/2003 | |
| WO | 03/097378 | A2 | | 11/2003 | |
| WO | 2004037646 | A2 | | 5/2004 | |
| WO | 2005095118 | A2 | | 10/2005 | |
| WO | 2006/076613 | A2 | | 7/2006 | |
| WO | 2006108607 | A2 | | 10/2006 | |
| WO | 2007045431 | A1 | | 4/2007 | |
| WO | 2007/070391 | A1 | | 6/2007 | |
| WO | 2007073833 | A1 | | 7/2007 | |
| WO | 2008/070532 | A2 | | 6/2008 | |
| WO | 2009118761 | A2 | | 10/2009 | |
| WO | 2012/031096 | A2 | | 3/2012 | |
| WO | 2013/104520 | A1 | | 7/2013 | |

OTHER PUBLICATIONS

Machine translation of JP 07-156,532 (Jul. 22, 2014).*

International Search Report of PCT/FR2010/052879, mailing date Apr. 12, 2011.

International Search Report of PCT/EP2012/076829 dated Apr. 12, 2013, corresponding to co-pending U.S. Appl. No. 14/365,562.

Opponent's Brief filed on May 6, 2015 in opposition to European Patent No. 2 516 741B1 issued from counterpart European Patent Appl. No. 10809308.9 (w/ English translation, 50 pages).

"Glanzmessgerät". wikipedia.de [online]. Retrieved May 5, 2015 from https://de.wikipedia.org/wiki/Glanzmessger%C3%A4t (w/ English partial translation and partial machine translation based on the Sep. 3, 2014 version of the article, 8 pages). Cited as B01 in Opponent's Brief and E26 in Proprietor's Reply.

"Spiegel". wikipedia.de [online]. Retrieved May 5, 2015 from https://de.wikipedia.org/wiki/Spiegel (w/ English partial translation and partial machine translation based on the Apr. 27, 2015 version of the article, 31 pages). Cited as B02 in Opponent's Brief and E27 in Proprietor's Reply.

"Indigo digital press". wikipedia.com [online]. Retrieved Nov. 12, 2015 from https://en.wikipedia.org/wiki/Indigo_Digital_Press (in English, 5 pages). Cited as E28 in Proprietor's Reply.

Advantage MG White Gloss paper. Datasheet [online]. Mondi. Retrieved Dec. 16, 2015 from http://www.mondigroup.com/products/PortalData/1/Resources/products_services/packaging/kraft_papers/kraft_paper/2012/Advantage_MG_White_Gloss_Data_Sheet_2012.pdf (in English, 2 pages). Cited as E29 in Proprietor's Reply.

Alaska Plus Coated Folding Boxboard. Datasheet [online]. International Paper. Retrieved Dec. 16, 2015 from http://www.internationalpaper.com/Apps/Alaska-Plus/files/technical/Alaska%20Plus%20technical%20datasheet%20FR.pdf (w/ English translation, 2 pages). Cited as E30 in Proprietor's Reply.

AP-Tec Liner paper. Datasheet [online]. Arctic Paper. Retrieved Dec. 16, 2015 from http://www.arcticpaper.com/Global/APTec/Global%20files/SHORT_ENG_APTecLiner_140227.pdf (in English, 1 page). Cited as E31 in Proprietor's Reply.

Duplex Coated Board with Grey Back. Datasheet [online]. Atrak Pulp & Paper. Retrieved Dec. 16, 2015 from http://www.atrak-pp.com/download/Spec_Ctd%20Duplex_Bd(GB).pdf (in English, 1 page). Cited as E32 in Proprietor's Reply.

(56) References Cited

OTHER PUBLICATIONS

Condat gloss paper. Datasheet [online]. Condat. Retrieved Dec. 16, 2015 from http://www.condat-pap.com/pdf_tech/CondatGloss.pdf (in English, 1 page). Cited as E33 in Proprietor's Reply.
Proprietor's Reply filed on Jan. 4, 2016 in response to Opponent's Brief (w/ English translation, 43 pages).
Office Action dated Oct. 31, 2013, issued in counterpart Japanese application No. 2012-545398 (w/ English partial translation, and machine translation) (11 pages).
Office Action dated Oct. 15, 2014, issued in counterpart Japanese application No. 2012-545398 (w/ English partial translation, and machine translation) (10 pages).
Office Action dated Jul. 24, 2015, issued in counterpart Japanese application No. 2012-545398 (w/ English partial translation, and machine translation) (8 pages).
Office Action dated Dec. 17, 2015, issued in co-pending U.S. Appl. No. 14/365,562; with PTO-892; without returned IDS forms SB08 (21 pages).
Office Action dated Jun. 8, 2016, issued in co-pending U.S. Appl. No. 14/365,562 with PTO-892; without returned IDS forms SB08 (21 pages).
Taiwanese Office Action dated Mar. 24, 2016 in Taiwanese Application No. 102100911, counterpart of co-pending U.S. Appl. No. 14/365,562; with English translation (14 pages).

* cited by examiner

PRINTABLE SHEET THAT IS ULTRA-SMOOTH AND RECYCLABLE, AND ITS METHOD OF FABRICATION

FIELD OF THE INVENTION

The present invention relates to a printable sheet that is smooth or ultra-smooth and recyclable, and also to its method of fabrication. The sheet may be used in distinct fields such as packaging, electronics, optics, or graphic arts, e.g. as a print medium, in particular for printing a photographic image.

BACKGROUND OF THE INVENTION

In the prior art, an ultra-smooth sheet can be fabricated by laminating a plastics film on one face of a paper, the plastics film defining an ultra-smooth face on the paper. The base paper is made of a fibrous material and its faces present relatively large roughness, of the order of about 20 micrometers (μm), i.e. each of its faces has projections and indentations with the height between them being of the order of 20 μm. Laminating a plastics film on one of the faces of such a paper serves to impart very small roughness to that face, roughness of the order of 1 μm when using a polyethylene terephthalate (PET) film.

Since paper is a material that is relatively expensive and that is produced on a large scale, it is important for it to be recyclable. Nevertheless, a paper-based sheet that is ultra-smooth because it includes a plastics film is not recyclable or is difficult to recycle, which is therefore neither ecological nor inexpensive. When recycling paper-based sheets, the sheets are chopped up and mixed with water in a pulper in order to form a paper pulp. When such sheets include plastics films, those films are torn up in the pulper and their plastics material pollutes the pulp.

With the present state of the art, it is therefore not possible to fabricate an ultra-smooth sheet that is recyclable, and preferably entirely recyclable.

Furthermore, such an ultra-smooth sheet is not printable and a printable resin needs to be deposited on the plastics film of the sheet in order to make it printable. That technique is used in particular for fabricating paper-based sheets for printing photographic images (known as "resin-coated photographic papers"), where such sheets have a polyethylene (PE) film with Bekk smoothness of about 6000 seconds (s).

A smooth sheet may also be fabricated by depositing a coating layer on one face of a paper, with that composition, once dry, defining a smooth face on the paper. That technique makes it possible to fabricate a smooth sheet without a plastics film. The composition is deposited on the paper by a curtain coating technique, with a scraper or trailing blade, with an air knife, by photogravure, or by rollers (size press, film press, etc.). The face of the base paper onto which the coating composition is deposited has alternating depressions and projections, the depressions being filled by the coating composition and the projections being made even during coating, thereby enabling the roughness of the paper to be reduced. Nevertheless, that technique does not enable a sheet to be obtained that is as smooth as a sheet covered in a plastics film, even if the sheet is subsequently smoothed, e.g. by calendering.

The method presently used for fabricating a smooth and glossy sheet consists in depositing a coating composition on a base paper by means of a mechanical roller having a cylindrical surface that is very smooth and that is covered in a layer of chromium. The Bekk smoothness of a sheet obtained by that method is of the order of 50 s and is therefore nevertheless smaller than that of a sheet having a plastics film (which is about 6000 s when a PE film is applied).

Furthermore, it is difficult to obtain a smooth sheet by coating a composition onto a paper that is relatively rough. When the above-mentioned depressions in the face of the paper are too large or too numerous, the coating composition does not fill the depressions completely, or else too great a quantity of composition is required to do that.

This applies for example to a paper having relatively large bulk, e.g. greater than 1.10 cubic centimeters per gram ($cm^3/g$), which therefore has faces that are relatively rough and poor printability. Coating a composition on a face of such paper, even using large quantities of composition, does not enable a smooth sheet to be fabricated, and also considerably reduces its bulk. Furthermore, even though calendering the sheet makes it possible to increase its smoothness, that is achieved to the detriment of its bulk.

In the prior art, it is therefore not possible to fabricate, under satisfactory conditions, a smooth sheet starting from a rough paper and/or having relatively large bulk.

SUMMARY OF THE INVENTION

A particular object of the invention is to provide a solution to the problems of the prior art that is simple, effective, and inexpensive.

The invention proposes a method of fabricating a sheet that is smooth, also known as ultra-smooth in the meaning of the invention, with the smoothness of the sheet being independent of the roughness of the paper or more generally of the base substrate used, and the sheet not including a plastics film and therefore being recyclable, at least in part, or indeed biodegradable.

To this end, the invention provides a method of fabricating a printable sheet presenting at least one face that is smooth, and advantageously ultra-smooth, the sheet comprising a substrate, in particular made of paper, having at least one face covered at least in part in a layer or a plurality of superposed layers, the method comprising the steps consisting in:

a) preparing or providing a multilayer structure comprising at least, or constituted by, a preferably smooth plastics film, an anti-adhesive layer, and a printable layer, the anti-adhesive layer being interposed between the plastics film and the printable layer;

b) pasting adhesive on a face of the substrate and/or the face of the multilayer structure situated opposite from the plastics film, and applying said face of the substrate against said face of the multilayer structure so as to laminate the multilayer structure and the substrate; and c) withdrawing the plastics film from the printable layer, the printable layer defining said smooth or ultra-smooth face of the sheet.

In a particular implementation of the invention, the multilayer structure is prepared prior to implementing the method of fabricating the printable sheet. Under such circumstances, the multilayer structure is provided for performing the method of fabricating the printable sheet.

In the invention, the smooth or ultra-smooth face of the sheet is defined by a printable layer that is prepared on a so-called "donor" plastics film, said printable layer at this stage being contained within a multilayer structure and then being transferred onto the so-called "receiver" base substrate. The smoothness of the printable layer and thus of the sheet is determined by the smoothness of the plastics film of the multilayer structure, and therefore does not depend on the smoothness of the base substrate used. The invention thus enables the surface state of a plastics film to be transferred onto any substrate. In other words, the invention makes it possible to fabricate a smooth or ultra-smooth sheet from any substrate, advantageously such as a rough paper and/or a paper having relatively large bulk, e.g. greater than or equal to 1.10 $cm^3/g$, and without including a plastics film in the sheet as made in this way.

The sheet prepared by the method of the invention is thus both printable and recyclable.

In the present application, a printable sheet or a substrate for use in preparing a printable sheet means a thin element (thickness not exceeding 500 μm) that is preferably non-rigid and/or flexible.

The term printable layer or sheet is used to mean a layer or sheet suitable for being printed by any printing technique, and in particular by offset printing, ink jet printing, laser printing, heliogravure, flexography, dry toner printing, liquid toner printing, electrophotography, lithography, etc. A printable layer typically comprises a mixture of pigments and at least one binder, or is formed by a printable varnish based on one or more polymers of the following types: acrylic, vinyl, polyurethane, styrene, starch, polyvinyl alcohol, ethylene, or a mixture thereof. The ink is for depositing on the smooth or the ultra-smooth free surface of the printable sheet or of the printable layer. A recyclable sheet is a sheet that does not include a plastics film, e.g. a film made of a thermoplastic material or a thermosetting material.

According to a characteristic of the invention, printing on the printable layer does not lead to structural modification thereof, and in particular does not lead to a change in the state or the phase thereof (such as for example passing from a solid state to a liquid state and then returning to the solid state).

A multilayer structure of the invention as prepared or provided in the context of the method of the invention includes in particular, or is constituted by: a bottom plastics film, an intermediate anti-adhesive layer, and a printable top layer. The anti-adhesive layer covers at least a portion of the top face of the plastics film, and the printable layer covers at least a portion of the top face of the anti-adhesive layer.

The plastics film serves as a support for fabricating the printable layer. This film does not remain in the final product, i.e. the sheet, so the sheet is therefore recyclable. The top face of the film (situated beside the printable layer) is advantageously as smooth as possible, since the surface quality of the top face of the sheet, as defined by the printable layer, is a function of the surface quality of said top face of the plastics film. In other words, the smoother the plastics film of the multilayer structure, the smoother the resulting sheet.

The plastics film is selected from films made of the following plastics: polyethylene terephthalate (PET); polyethylene (PE); polypropylene (PP); a polymer based on polylactic acid (PLA); any polymer based on cellulose, etc. By way of example, the film has thickness of about 12 μm.

Advantageously, the plastics film does not include and/or is not covered in polyvinylidene fluoride (PVDF), polypropylene (PP), Teflon, silica, boron nitride, chromic chloride stearate, or any other substance having anti-adhesive properties.

The face of the film situated beside the printable layer is preferably smooth and may have smoothness greater than 10,000 s on the Bekk scale.

The thickness, the hardness, and the glass transition temperature of the plastics film have little or no influence on the characteristics of the printable layer. Only the smoothness, or on the contrary the roughness, of the plastics film has an influence on the smoothness or the roughness of the printable layer. The smoother the plastics film, the smoother the printable layer. The person skilled in the art is nevertheless capable of determining which characteristics of the plastics film are likely to influence the surface state of the printable layer, and of optimizing those characteristics as a function of the final smoothness that is to be obtained for the printable layer.

The anti-adhesive layer of the multilayer structure is deposited on the plastics film by any technique, e.g. by photogravure. The function of the anti-adhesive layer is to limit adhesion between the printable layer and the plastics film and to facilitate separation and withdrawal of the plastics film from the printable layer in step c) of the above-defined method. The anti-adhesive layer has little or no modifying effect on the smoothness and the surface quality of the face of the plastics film on which said layer is deposited.

The anti-adhesive layer may adhere more strongly to the plastics film than to the printable layer, so that most or even all of the anti-adhesive layer remains stuck to the plastics film when it is withdrawn from the printable layer. Nevertheless, it may happen that portions or traces of the anti-adhesive layer persist on the printable layer after the plastics film has been withdrawn.

In a variant, the anti-adhesive layer may adhere more strongly to the printable layer than to the plastics film, in which case it is intended to remain at least in part on the printable layer when the plastics film is withdrawn.

In yet another variant, the anti-adhesive layer is intended to split substantially into two portions while the plastics film is being withdrawn, a first portion remaining on the plastics film and a second portion remaining on the printable layer.

The multilayer structure may have two superposed anti-adhesive layers between the plastics film and the printable layer, these two layers being designed to separate from each other while the plastics film is being withdrawn (one of the anti-adhesive layers remaining on the plastics film and the other anti-adhesive layer remaining on the printable layer).

Leaving some or all of the anti-adhesive layer on the printable layer is particularly advantageous when the sheet is for use as a support in a casting application. A casting application consists in extruding or casting at least one polymer (such as polyurethane (PU), polyvinyl chloride (PVC), etc.) on a support coated in an anti-adhesive layer. The polymer may have a surface that is textured in order to impart a particular appearance on the sheet (e.g. similar to leather). Leaving an anti-adhesive layer on the sheet of the invention avoids the need for depositing another such layer on said sheet for a casting application, and is therefore advantageous in particular in terms of cost and in terms of the time required for preparing the support for the casting application.

The anti-adhesive layer has thickness less than or equal to 5 μm and preferably less than or equal to 1 μm. The anti-adhesive layer may be made up of silicone(s), siloxane(s), polysiloxane(s) or derivatives thereof, Werner complex(es), such as chromic chloride stearates, or waxes of polyethylene, propylene, polyurethane, polyamide, polytetrafluoroethylene, etc.

Advantageously, the anti-adhesive layer does not include PVDF.

The printable layer of the multilayer structure may be selected from a printable varnish, from a paper coating, etc.

In the present application, the term printable varnish is used to mean a substance based on: acrylic polymer, polyurethane, polymethyl methacrylate, styrene-butadiene, vinyl acetate, polyamide, nitrocellulose or any other cellulose, polyvinyl alcohol, starch, etc. This substance is generally deposited in liquid form and solidified by drying/heating or by ultraviolet (UV) radiation or electronic radiation.

The term "paper coating" or coating composition, is used to mean a composition comprising a binder and pigments. The binder may be based on: acrylic, polyurethane, polymethyl methacrylate, styrene-butadiene, vinyl acetate, polyamide, nitrocellulose or any other cellulose, polyvinyl alcohol, starch, or a mixture thereof. The pigments may be selected from calcium carbonates, kaolins, titanium dioxide, talc, silicas, mica, pearlescent particles, plastics pigments (polystyrene (PS), polyurethane (PU), etc.), and mixtures thereof. The quantity of binder relative to the pigments lies in the range 5% to 50% approximately, and preferably in the range 8% to 25%, by dry weight. The pigments generally comprise a majority relative to the binder in a paper coating so as to create pores to improve ink absorption. In contrast, in a thermal transfer layer the binders are in the majority over the pigments since the purpose is to avoid having surface pores.

The plastics material used in the printable layer (as binder and/or pigments) is easily fragmented and does not pollute the paper pulp on being recycled. In contrast, plastics films retain cohesion and clog filters when the paper pulp is put into suspension. Water soluble binders (such as starch, polyvinyl alcohol (PVA), etc.) are particularly advantageous in this respect, since they disperse in water during recycling.

The paper coating may also include a dispersant and/or a rheology modifier and/or a dye and/or a spreading or surface agent and/or a conductive additive. The conductive additive may be used to reduce the surface resistivity of the sheet.

Preferably, the printable layer is free of anti-adhesion agents and/or of substances that could reduce the surface energy of the layer, such as a silicone material or the like, PVDF, PP, Teflon, silica, boron nitride, etc. That type of agent or substance may be necessary for printing on a layer by thermal transfer, in particular in order to avoid the paper adhering to the printer ribbon. The printable layer of the invention may therefore be unsuitable for thermal transfer printing.

The printable layer may be made up of a plurality of sublayers superposed one on another, each sublayer being printable and being selected from the above-specified types (printable varnish, paper coating, etc.).

The printable layer may have thickness that is less than or equal to 30 μm, preferably less than or equal to 15 μm, and more preferably less than or equal to 10 μm. Its grammage (i.e. its weight in grams per square meter ($g/m^2$)), is advantageously less than or equal to 30 $g/m^2$, preferably less than or equal to 15 $g/m^2$, and more preferably less than or equal to 10 $g/m^2$. By way of example, the printable layer may have thickness and grammage that are less than or equal to the following combined values: 10 μm and 10 $g/m^2$; 3 μm and 10 $g/m^2$; 2 μm and 10 $g/m^2$; 5 μm and 5 $g/m^2$; 3 μm and 5 $g/m^2$; 2 μm and 5 $g/m^2$; 5 μm and 2 $g/m^2$; 3 μm and 2 $g/m^2$; or 2 μm and 2 $g/m^2$.

The printable layer may be deposited on the anti-adhesive layer by any technique, e.g. by photogravure.

The printable layer may be deposited on the anti-adhesive layer in the liquid or semi-liquid state and then solidified by drying, heating, or by electronic or UV radiation. After solidification and/or drying, the printable layer, which is in contact with the smooth face of the plastics film via the anti-adhesive layer, presents a face situated beside the plastics film that is smooth.

The printable layer is thus dried and/or solidified prior to being transferred onto the substrate, in particular so as to avoid modifying the surface state of said layer as imparted by the plastics film. In other words, the multilayer structure is prepared prior to transferring the printable layer onto the substrate, and the printable layer is in the solid and/or dry state while it is being transferred onto the substrate, i.e. during steps b) and c) of the method of the invention. The surface state of the printable layer is thus created while preparing the structure.

In the method of the invention, the printable layer is thus fabricated independently of the base substrate. This makes it possible in particular to implement the method with standard industrial tools, thus making optimized production rates possible.

The smooth face of the sheet may have Bekk smoothness greater than 900 s or 1000 s approximately, preferably greater than 2000 s, and more preferably greater than 5000 s. In the present application, a face is said to be smooth or ultra-smooth when it presents Bekk smoothness greater than 900 s or 1000 s approximately, advantageously greater than 2000 s, and more preferably greater than 5000 s.

The smooth face may present gloss greater than 70%, and preferably greater than 80%, the gloss being measured for example at 75° using the TAPPI® T480 om-92 method. The gloss may be similar to or greater than the gloss of a resin-coated photographic paper that includes a plastics film.

The multilayer structure may include at least one additional layer that is deposited on the printable layer on its side opposite from the plastics film, the free face of the additional layer or of the additional layer farthest from the plastics film serving, in step b), to be pasted and applied against the above-specified face of the substrate.

The additional layer(s) may be functional or non-functional. By way of example, it may be insulating (dielectric) or it may form a barrier (against gas, e.g. oxygen, liquids, e.g. water, fats, etc.).

When the multilayer structure includes a single additional layer, it is deposited on the top face of the printable layer, i.e. on the face of the printable layer that is situated on its side opposite from the plastics film of the multilayer structure. This additional layer may be of any kind, and therefore need not necessarily be printable. When the multilayer structure has two or more additional layers, these additional layers are superposed one on another and deposited on the above-mentioned top face of the printable layer. The technique(s) used for depositing the additional layer(s) on the printable layer may be of the above-mentioned types, or of any other type.

The multilayer structure may thus include, in addition to the above-mentioned three elements (plastics film, anti-adhesive layer, and printable layer), one or more optionally-printable additional layers on the printable layer (on the side opposite from the plastics film). The multilayer structure may also include a layer or film of adhesive covering the layer that is farthest from the plastics film (i.e. the printable layer or the or one of the additional layer(s)).

Step b) of the method of the invention then consists in pasting the face of the substrate that is to receive the printable layer or the face of the multilayer structure that is situated on its side opposite from the plastics film, and in applying those faces against each other so as to fasten them together.

The substrate may be selected from: paper, tracing paper, card stock, and coated or precoated paper. The paper may present relatively large bulk, greater than or equal to 1.10 $cm^3/g$, preferably greater than or equal to 1.2 $cm^3/g$, more preferably greater than or equal to 1.3 $cm^3/g$, more particularly greater than or equal to 1.4 $cm^3/g$, and even more particularly greater than or equal to 1.5 $cm^3/g$.

The method of the invention makes it possible to make a sheet having bulk and smoothness that are considerable, which is not possible in the prior art. In the prior art it is not possible to make a sheet having both large bulk and good surface quality. A substrate having large bulk may be made of a material that is inexpensive. With a paper, the paper pulp used may comprise cellulose fibers, a binder, and a small amount of fillers and/or additives, such as starch.

In a particular implementation of the invention, the method of the invention leads to a small reduction in the bulk of the paper substrate, by about 2% to 5%.

A smooth or ultra-smooth sheet presenting large bulk and fabricated by the method of the invention presents good printability and low grammage, thereby enabling packaging to be made that is light in weight but that presents relatively great rigidity.

During step b) of the method, the face for lining the substrate or the free face of the printable layer or of an additional layer of the multilayer structure is pasted using an appropriate adhesive.

In a variant, the two above-mentioned faces of the substrate and of the multilayer structure are pasted simultaneously, or else one after the other.

Pasting consists in depositing a layer of adhesive on the above-mentioned face(s) using any technique, e.g. such as photogravure. The adhesive may be of the thermal type, of the non-thermal type, of the UV-cured type, or of the type involving a chemical reaction. The adhesive may be deposited on the or each of the above-mentioned faces in liquid or non-liquid form (e.g. it may be a thermoadhesive film). By way of example, the adhesive is selected from the following polymers: acrylic, polyurethane, polymethyl methacrylate, styrene-butadiene, vinyl acetate, polyamide, nitrocellulose or any other cellulose, polyvinyl alcohol, or starch. The or each layer of deposited adhesive may present thickness that is less than or equal to 10 μm, preferably less than or equal to 3 μm.

In a particular implementation of the invention, the adhesive is deposited on the above-specified face of the multilayer structure while the structure is being prepared. The adhesive then forms an integral portion of the multilayer structure. The adhesive may be formed by a thermally activatable adhesive layer, which layer is activated by heating while the multilayer structure is being applied against the (receiver) substrate.

The nature of the adhesive and the adhesion process (on the film and/or on the paper) may have a considerable influence on the final surface state of the paper. For example, it is important for the adhesive to be deposited uniformly while avoiding any cavities being formed between the paper and the printable layer.

Concerning the uniformity of the deposited adhesive, adhesive deposition is preferably uniform so as to avoid there being too much or too little adhesive in various locations, since that would give rise to a final sheet presenting surface roughnesses. Advantageously, the adhesive spreads well over the support (film or paper) because it has appropriate surface tension and rheology.

The way in which the adhesive is coated may also be important. Coating methods that give rise to a deposit that is as uniform as possible, such as photogravure (reverse roll or kiss coating) are preferred. Deposition is preferably selected to that it fills the pores or surface irregularities of the paper as much as possible. For example, when paper has mean surface roughness (e.g. Sa) of about 20 μm, then it is preferable to deposit the adhesive with a thickness of not less than 10 μm in order to fill in the pores. Adhesive deposition is preferably performed on the paper when the paper is not too rough. If deposition on the paper is not sufficient, then cavities form between the surface of the paper and the printable layer. During printing, these cavities become points of weakness in the paper that may either cave in if pressure is exerted, or else flake off if traction is exerted.

Advantageously, the thickness of the adhesive deposited on the paper and/or the printable layer is equal to not less than half the mean surface roughness (e.g. Ra or Sa) of the paper. In an implementation of the invention, the adhesive is deposited on at least one face of the substrate in step b), and the thickness of the deposited adhesive layer is not less than half the mean roughness of the face of the substrate, and is preferably equal to said mean roughness.

The adhesive may have a water base, a solvent base, or be without solvent, and comprise two components or only one component.

The adhesive enables the printable layer (or an additional layer) to be fastened onto the substrate and, where appropriate, enables surface irregularities of the substrate to be compensated. In particular, the adhesive fills in depressions in the face for lining of the substrate and thus enables said face to be made plane, but without modifying the characteristics of the substrate such as its bulk.

Step b) of the method then consists in applying the above-mentioned face of the substrate against the above-mentioned face of the multilayer structure so as to laminate them together. The printable layer is then sandwiched between firstly the substrate with the adhesive on one side (possibly together with one or more additional layers), and secondly the plastics film with the anti-adhesive layer on the other side.

When the adhesive used for sticking the substrate onto the multilayer structure is of the thermally adhesive type, the substrate is applied to the multilayer structure while hot, at some given temperature, which may for example lie in the range about 50° C. to 200° C. In a variant, the substrate may be applied and bonded to the multilayer structure at ambient temperature.

A small amount of pressure may be necessary for ensuring good adhesion of the printable layer on the substrate, via the adhesive.

The temperature and/or the pressure used during application and bonding should nevertheless not modify the characteristics of the printable layer, and in particular the surface state of its face situated beside the plastics film. For example, the printable layer must not be softened by high temperature application, since that could lead to a modification of and a decrease in the surface quality of its face situated beside the plastics film.

Thereafter, step c) of the method consists in withdrawing the plastics film from the printable layer and the substrate in such a manner that the printable layer (and where appropriate the above-mentioned additional layer(s) of the multilayer structure) remain(s) on the substrate. The printable layer, and where appropriate the additional layer(s), is/are thus transferred from the "donor" plastics film of the multilayer structure onto the "receiver" substrate.

As explained above, at least some and advantageously most or all of the anti-adhesive layer may remain on the plastics film so that it is withdrawn from the printable layer while the plastics film is being withdrawn. The face of the printable layer that was situated beside the plastics film in the multilayer structure is therefore exposed, said face defining the smooth face of the sheet.

The printable layer of the multilayer structure may be transferred onto the substrate during steps b) and c) of the method in the manner described below when the substrate and the multilayer structure are in the form of continuous strips.

The multilayer structure and the substrate may be laminated together by passing them between two parallel and adjacent mechanical rollers rotating in opposite directions. The thickness of the resulting product is a function in particular of the distance between the rollers. Once the adhesive has dried or solidified, the plastics film is withdrawn from the sheet while it is being driven by another mechanical roller.

In a variant, it is possible to paste either the multilayer structure or the substrate, to allow the adhesive to dry, and then to put those two elements into contact one against the other while applying a determined temperature and pressure.

Prior to step b), the method may also consist in the above-mentioned face of the substrate being precoated with at least one smoothing coat having one or more thermoplastic polymers (such as at least a polystyrene, a polyurethane, an acrylic, etc.) or a mixture of pigments (such as kaolins, calcium carbonates, talc, titanium dioxide, etc., and mixtures thereof) and at least one binder (such as a binder based on: acrylic, polyurethane, polymethyl methacrylate, styrene-butadiene, vinyl acetate, polyamide, nitrocellulose or any other cellulose, starch, or PVA).

This precoated face of the substrate may also be calendered prior to step b) in order to increase its smoothness.

The method of the invention may include an additional step consisting in printing the sheet with an ink having electrical and/or optical properties.

The present invention also provides a method of preparing a multilayer structure comprising at least or constituted by: a plastics film, an anti-adhesive layer, and a printable layer, the anti-adhesive layer being interposed between the plastics film and the printable layer.

The present invention also provides a method of printing a sheet prepared by the above-described method, the printing method comprising a step of printing the sheet without modifying the state of its printable layer, i.e. without softening or melting said layer during printing. By way of example, the sheet may be printed by offset printing, ink jet printing, laser printing, photogravure, flexographic printing, dry toner, liquid toner, electrophotography, lithography, etc.

The present invention also provides a method of fabricating a sheet for casting application presenting at least one smooth face, the sheet having a substrate, in particular a paper substrate, with at least one face covered at least in part by a layer or a plurality of superposed layers, the method comprising the steps consisting in:

a) preparing or providing a multilayer structure comprising at least, or constituted by, a plastics film, an anti-adhesive layer, and a layer for casting application, the anti-adhesive layer being interposed between the plastics film and the layer for casting application;

b) pasting adhesive on a face of the substrate and/or the face of the multilayer structure situated opposite from the plastics film, and applying said face of the substrate against said face of the multilayer structure so as to laminate the multilayer structure and the substrate; and c) withdrawing the plastics film from the layer for casting application, the printable layer defining said smooth face of the sheet.

By way of example, the layer for casting application is a layer of PVA. The layer for casting application may have anti-adhesive properties.

The present invention also provides a printable sheet presenting at least one face that is smooth and advantageously ultra-smooth, the sheet comprising a substrate, in particular a paper substrate, having at least one face covered at least in part in one or more layers including a printable layer defining said smooth or ultra-smooth face, the sheet being characterized in that said smooth or ultra-smooth face has Bekk smoothness greater than 900 s, or greater than 1000 s, approximately, preferably greater than 2000 s, and more preferably greater than 5000 s.

The smooth or ultra-smooth face of the sheet may have gloss greater than 70% and preferably greater than 80%, the gloss being measured for example at 75° using the TAPPI® T480 om-92 method.

The printable layer of the sheet may have thickness less than or equal to 30 μm, preferably less than or equal to 15 μm, and more preferably less than or equal to 10 μm. The grammage of the printable layer may be less than or equal to 30 $g/m^2$, preferably less than or equal to 15 $g/m^2$, and more preferably less than or equal to 10 $g/m^2$. By way of example, the printable layer may have thickness and grammage that are less than or equal to the following combined values: 10 μm and 10 $g/m^2$; 3 μm and 10 $g/m^2$; 2 μm and 10 $g/m^2$; 5 μm and 5 $g/m^2$; 3 μm and 3 $g/m^2$; 2 μm and 5 $g/m^2$; 5 μm and 2 $g/m^2$; 3 μm and 2 $g/m^2$; or 2 μm and 2 $g/m^2$.

The present invention also provides the use of a printable sheet as described above for making an electronic or optical component, the sheet being printed by means of an ink having electrical and/or optical properties.

The sheet of the invention may be compatible with electronic organic inks for electronic applications, such as for example making radio frequency identification (RFID) chips, display or detection systems, etc., directly on the sheet.

In the prior art, an RFID chip can be made on a sheet constituted by a plastics film of polyethylene terephthalate (PET). Nevertheless, such a plastics film is of mechanical strength and temperature behavior that are relatively poor, thereby limiting potential applications for the chip and preventing the film being printed with inks at relatively high temperatures. Furthermore, a film made of PET is not simple to recycle. In contrast, when the substrate of the sheet of the invention is made of paper, the sheet presents better mechanical strength and better high temperature behavior.

A sheet printed with an ink having electrical properties advantageously comprises a flexible substrate and a printable layer that presents little or no electrical conductivity. A sheet of this type can be used for making organic thin-film transistors using conductive or semiconductive organic inks.

The sheet of the invention may also be used for making optical components, such as waveguides, holographic patterns, etc.

By way of example, the above-defined method may include, prior to step a), a preliminary step consisting in making, e.g. by etching, recessed or projecting patterns on the face of the plastics film that is to receive the anti-adhesive layer and the printable layer, the printable layer being intended to fit closely to the shape of the patterns so as to include an imprint of the above-mentioned face of the plastics film.

Under such circumstances, transferring the surface state of the film to the printable layer comprises both transferring the smooth surface and also the patterns of the plastics film. The patterns transferred to the printable layer themselves present surfaces and/or walls that are smooth in appearance and that are accurately defined. The method is thus particularly advantageous for making optical components of the above-specified type.

Finally, the present invention provides the use of a printable sheet as described above for printing a photographic image, for making packaging, and/or for a casting application.

BRIEF DESCRIPTION OF THE DRAWINGS

The invention can be better understood and other details, characteristics, and advantages of the present invention appear more clearly on reading the following description made by way of non-limiting example and with reference to the accompanying drawings, in which.

DETAILED DESCRIPTION

Figure 1:
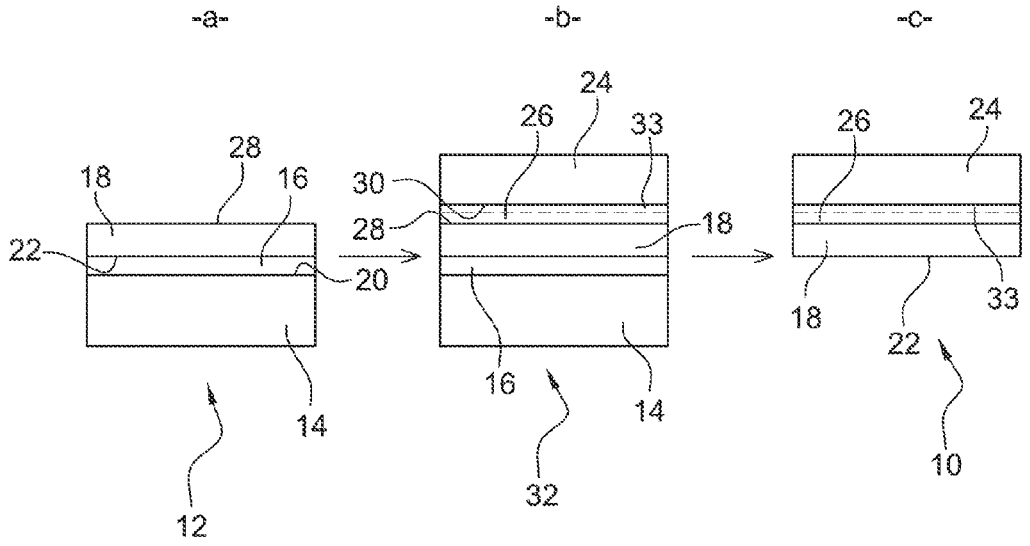
FIG. 1 is a highly diagrammatic view of the steps in the method of the invention for fabricating a smooth or ultra-smooth printable sheet.

Reference is made to FIG. 1 which shows in highly diagrammatic manner the steps a), b), and c) of the method of the invention for fabricating a smooth or ultra-smooth printable sheet 10 that is entirely recyclable.

Step a) of the method consists in preparing a multilayer structure 12 comprising a bottom plastics film 14, an anti-adhesive intermediate layer 16, and a printable top layer 18. This structure 12 may be prepared in a single step or in a plurality of successive steps.

The anti-adhesive layer 16 and the printable layer 18 may be deposited simultaneously on the plastics film 14, e.g. using a curtain coating technique.

In a variant, the anti-adhesive layer 16 is deposited on the plastics film 14, and then the printable layer 18 is deposited on the anti-adhesive layer.

The quality of the top face 20 of the plastics film 14 is transmitted to the bottom face 22 of the printable layer 18 (via the anti-adhesive layer 16). The surface characteristics of the face 22 of the printable layer are thus defined by the surface characteristics of the face 20 of the plastics film 14.

By way of example, the roughnesses of the films and papers have been tested using an Altisurf 500 type topography-measuring appliance from the supplier Altimet. The first tested film had roughness (e.g. Sa) of 1 μm. That film was used for transferring a printable layer onto Bristol® paper from the supplier Arjowiggins. The roughness measured on said printable layer was 1.1 μm. The second film had roughness of 0.5 μm. That film was used for transferring a printable layer onto another Bristol® paper. The roughness measured on said printable layer was 0.7 μm. The roughness (or surface state) of the film was thus indeed transferred from the films to the printable layers. After drying and/or solidification of the printable layer, the surface characteristics of the face 22 are "frozen" and are not intended to be modified during other steps of the method, and in particular while transferring the printable layer 18 onto a substrate 24, such as a paper, to be lined.

The printable layer 18 may be made of a printable varnish or a resin or a paper coating including a binder and pigments. In a variant, the printable layer may comprise two or more sublayers that are selected from a printable varnish and a paper coating. When the printable layer comprises two sublayers, i.e. a printable varnish and a paper coating, the printable varnish is situated over or under the paper layer, such that the above-mentioned bottom face 22 of the printable layer is defined by the printable varnish or by the paper coating.

Step b) of the method consists in depositing a layer or film of adhesive 26 on the top face 28 of the printable layer 18 or on the bottom face 30 for lining of the substrate 24, or indeed on both of the faces 28 and 30, and then in applying these faces 28 and 30 against each other in order to laminate the multilayer structure 12 and the substrate 24, and thus form a laminated product 32.

Step c) of the method consists in withdrawing the plastics film 14 and the anti-adhesive layer 16 from the printable layer 18 so that only the layer 18 (and the adhesive 26) remains on the substrate 24.

Steps b) and c) may be performed simultaneously or one after the other. If performed one after the other, the adhesive 26 is advantageously in the dry and/or solidified state when the plastics film 14 is withdrawn.

At the end of step c), the face 22 of the printable layer 18 is exposed, this face being smooth or ultra-smooth.

Nevertheless, a portion of the anti-adhesive layer 16 may remain on the face 22 of the printable layer 18 after the plastics film has been withdrawn.

The layer 18 is suitable for printing using any suitable technique, the ink being deposited on the smooth or ultra-smooth face 22 of the sheet 10.

In a variant, the substrate 24 may be made of a coated or precoated paper, i.e. a paper with one of its faces having deposited thereon a coating or precoating 33 that comprises one or more thermoplastic polymers or a mixture of pigments and binder. This coating or precoating 33 is for depositing on the above-mentioned face 30 of the substrate, and it is advantageously smoothed by calendering. It is for being bonded subsequently on the face 28 of the printable layer 18.

Figure 2:
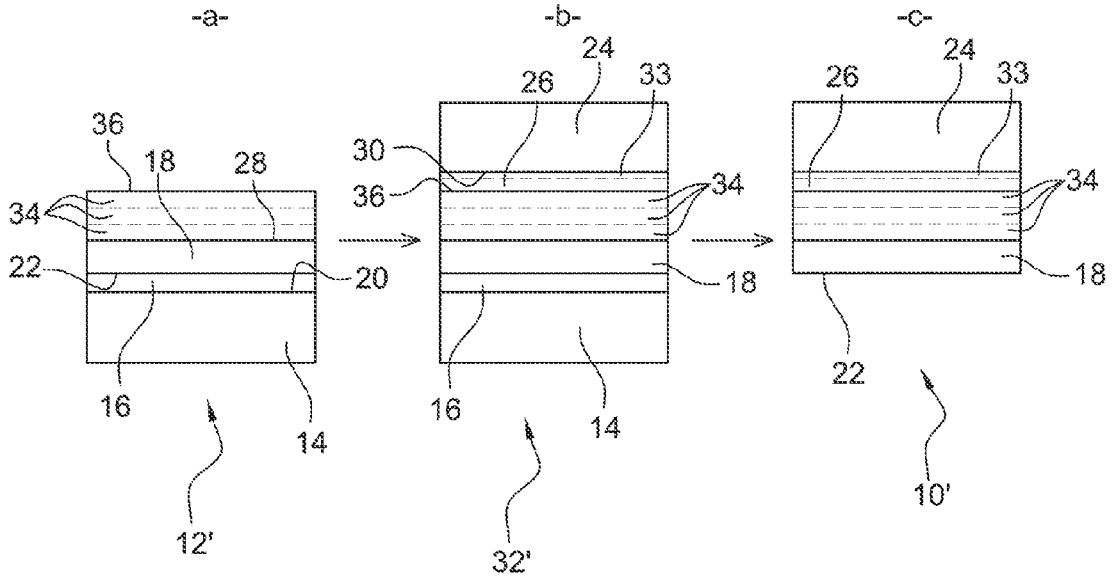
FIG. 2 is a highly diagrammatic view showing a variant implementation of the method of the invention.

FIG. 2 shows a variant implementation of the method of the invention that differs from the method described above with reference to FIG. 1 in particular in that the multilayer structure 12' also includes an additional layer 34 deposited on the top face 28 of the printable layer 18.

A plurality of superposed additional layers 34 may be deposited (simultaneously or successively) on the face 28 of the printable layer 18. Each of the additional layers 34 may be printable or non-printable.

During step b), the bottom face 30 of the substrate 24 or the free top face 36 of the additional layer 34 (the layer farthest from the plastics film, when the structure 12' has a plurality of additional layers) is covered in adhesive 26. In a variant both of these faces 30 and 36 are covered in adhesive 26.

During step c), the multilayer structure 12' and the substrate 24 are laminated so as to form a lined or laminated product 32', and then the plastics film 14 and the anti-adhesive layer are withdrawn, so as to expose the smooth or ultra-smooth face 22 of the printable layer 18 of the sheet 10'.

As in FIG. 1, the sheet of FIG. 2 may include a previously precoated substrate 24 on its face 30 in order to increase its smoothness. The precoating 33 is of the same type as that described with reference to FIG. 1.

Figure 3:
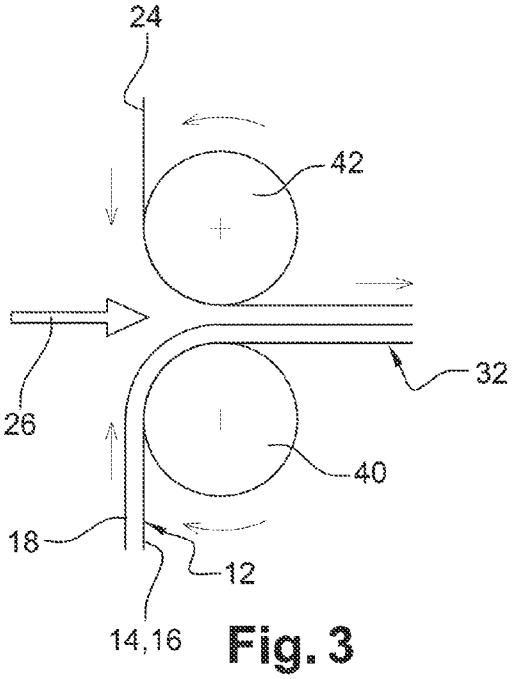
FIGS. 3 and 4 are highly diagrammatic views of means for performing the transfer step of the method of the invention.
Figure 4:
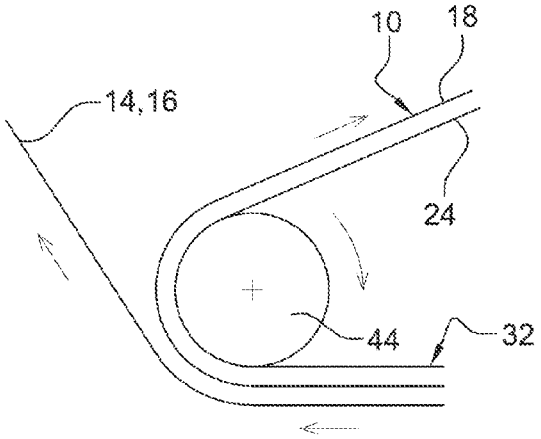

FIGS. 3 and 4 are diagrams showing means implemented during the transfer step c) of the method of the invention.

A first roller 40 serves to drive a continuous strip of the multilayer structure 12 (made up of a plastics film 14, an anti-adhesive layer 16, and a printable layer 18—optionally together with one or more additional layers 34). A second roller 42 that is parallel and adjacent to the first roller 40 serves to drive a continuous strip of the substrate 24.

The rollers 40 and 42 rotate in opposite directions and they are spaced apart by a short distance so that the multilayer structure 12 and the substrate 24 are forced to pass between the rollers while being subjected to a given level of pressure one against the other in order to laminate them.

The adhesive 26 may be deposited on the multilayer structure 12 and/or on the substrate 24, as mentioned above, prior to this laminating step, or during this laminating step. If the adhesive 26 is applied during the laminating step, it may be injected between the structure 12 and the substrate before they pass between the rollers, as represented diagrammatically by the broad arrow in FIG. 3.

A third roller 44 drives the sheet 10 formed by the substrate 24 and the printable layer 18 in one direction, while the plastics film 14 and the anti-adhesive layer 16 are driven in another direction in order to separate them from the sheet 10.

Figure 5:
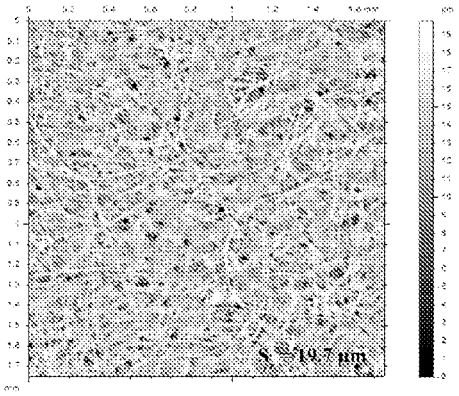
FIGS. 5 and 6 are images obtained by a scanning electron microscope (SEB) respectively showing a face of base paper and a face of a smooth or ultra-smooth sheet obtained by the method of the invention.
Figure 6:
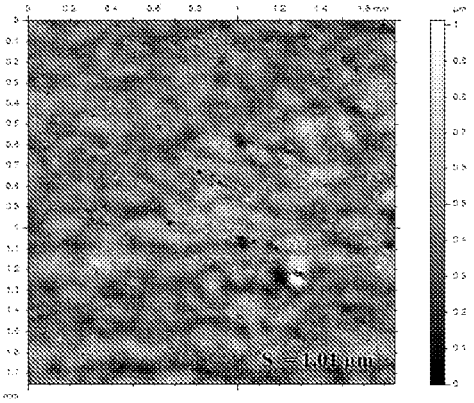

FIGS. 5 and 6 are images obtained by a scanning electron microscope (SEB) showing respectively a face of a base substrate or paper 24 and a smooth or ultra-smooth face of a sheet 10 as fabricated by the method of the invention.

The base paper (FIG. 5) in this example is made of mutually mixed cellulose fibers that define a rough face. The roughness Sz of this face is about 19.7 μm, which means that the maximum surface height from the highest point to the deepest value is equal to 19.7 μm.

The sheet of the invention (FIG. 6) has a smooth or ultra-smooth face defined by its printable layer which has roughness Sz of the order of 1.01 μm, with this being comparable to that of a prior art paper covered in a plastics film, having roughness Sz of the order of 1.5 μm.

This roughness value of 1.01 μm for the sheet of the invention is given by way of indication and illustrates a particular example of an embodiment of the invention.

Other examples illustrating the present invention are described below.

EXAMPLE 1

Preparing an Offset-Printable Smooth or Ultra-Smooth Sheet

A smooth or ultra-smooth sheet of the invention for offset printing was prepared from a printable layer A having the following composition:

| Composition of layer A | | |
|---|---|---|
| Pigments | Calcium carbonate<br>Hydrocarb ® 60 OG (Omya) | 1248 g |
| Binder | Aqueous dispersion of n-butyl acrylate-acrylonitrile-styrene copolymer<br>Acronal ® S504 (BASF) | 300 g |
| Dispersant | Sulfoccinic acid-isooctyl ester, sodium salt<br>Agnique ® EHS 75E (Cognis) | 3 g |
| Rheological modifier | Aqueous dispersion of acrylic copolymer<br>Sterocoll ® FD (BASF) | 0.6 g |
| Spreading agent | Non-ionic surfactant<br>Surfynol ® 420 (Safic-Alcan) | 0.2 g |

The printable layer A had a final concentration of 50% by weight and a viscosity of 100 centipoise (cps) measured with the help of a Brookfield® viscosimeter.

The layer A was applied on one face of a PET plastics film that had previously been covered in an anti-adhesive layer based on chromic chloride stearate. The layer A was deposited on the film at about 10 g/m$^2$. The layer A was then dried in an oven at 70° C. This produced a multilayer structure constituted by a PET plastics film, an anti-adhesive layer of chromic chloride stearate, and the printable layer A.

The free face of the layer A, i.e. the face situated on its side opposite from the plastics film, was pasted with a Super-Lok® 364 adhesive from the supplier National Starch. The adhesive was deposited at 3 g/m$^2$ on the layer A. The pasted face of the layer A was applied against a substrate formed by a 335 g/m$^2$ Bristol® paper fabricated by the supplier Arjowiggins, and then the assembly was dried in an oven at 70° C. Step b) of the method was then terminated.

Thereafter plastics film and the anti-adhesive layer were withdrawn (during step c)) so as to leave only the printable layer A and the adhesive on the paper substrate.

The prepared sheet was suitable for offset printing. It was not suitable for thermal transfer printing. This was confirmed by a printing test performed on the sheet obtained in Example 1 using a Canon Selphy CP800 thermal transfer printer. Yellow, cyan, and magenta were transferred poorly, and black was not transferred at all. The final image was not acceptable.

EXAMPLE 2

Preparing an Offset-Printable Smooth or Ultra-Smooth Sheet from a Featherweight Paper or a Paper of Relatively Large Bulk The printable layer A of Example 2 was prepared and applied in the same manner and under the same conditions as those described for Example 1 onto an Elementa® bulk featherweight paper from the supplier Arjowiggins. That paper had initial bulk of 1.4 (cm$^3$/g).

EXAMPLE 3

Preparing an Offset-Printable Smooth or Ultra-Smooth Sheet from a Precoated Support Paper The printable layer A of Example 3 was prepared and applied in the same manner and under the same conditions as those described for Example 1 onto a Maine Gloss® precoated paper from the supplier Arjowiggins. That paper had an initial Bekk smoothness of 400 s.

EXAMPLE 4

Preparing an Offset-Printable Smooth or Ultra-Smooth Colored Sheet

A smooth or ultra-smooth colored sheet of the invention was prepared for offset printing from a printable layer B having the following composition:

| Composition of the printable layer B | | |
|---|---|---|
| Pigments | Calcium carbonate<br>Hydrocarb ® 60 OG (Omya) | 1248 g |
| Binder | Aqueous dispersion of n-butyl acrylate-acrylonitrile-styrene copolymer<br>Acronal ® S504 (BASF) | 300 g |
| Dispersant | Sulfoccinic acid-isooctyl ester, sodium salt<br>Agnique ® EHS 75E (Cognis) | 3 g |
| Rheological modifier | Aqueous dispersion of acrylic copolymer<br>Sterocoll ® FD (BASF) | 0.6 g |
| Spreading agent | Non-ionic surfactant<br>Surfynol ® 420 (Safic-Alcan) | 0.2 g |
| Dye | Bleu Levacell ® B liq (Bayer) | 0.1 g |

The printable layer B had a final concentration of 50% by weight and viscosity of 100 cps, measured with the help of a Brookfield® viscosimeter.

The layer B was applied onto one face of a PET plastics film that had previously been covered in an anti-adhesive layer based on chromic chloride stearate. The layer B was deposited on the film at about 10 g/m$^2$. The layer B was then dried in an oven at 70° C. This produced a multilayer structure constituted by the PET plastics film, an anti-adhesive layer of chromic chloride stearate, and the printable layer B.

The free face of the layer B, i.e. the face situated on the side opposite from the plastics film, was pasted with a Super-Lok® 364 adhesive from the supplier National Starch. The adhesive was deposited at 3 g/m$^2$ on the layer B. The pasted face of the layer B was applied against a substrate constituted by a 335 g/m$^2$ Bristol® paper fabricated by the supplier Arjowiggins, and then the assembly was dried in an oven at 70° C.

The plastics film and the anti-adhesive layer were subsequently withdrawn so as to leave only the printable layer B and the adhesive on the paper substrate.

The resulting paper had very uniform coloring.

EXAMPLE 5

Preparing an Offset-Printable Smooth or Ultra-Smooth Sheet Having Low Surface Resistivity A smooth or ultra-smooth sheet of the invention having low surface resistivity and for offset printing was prepared from a printable layer C having the following composition:

| Composition of the printable layer C | | |
|---|---|---|
| Pigments | Calcium carbonate<br>Hydrocarb ® 60 OG (Omya) | 1248 g |
| Binder | Aqueous dispersion of n-butyl acrylate-acrylonitrile-styrene copolymer<br>Acronal ® S504 (BASF) | 300 g |
| Dispersant | Sulfoccinic acid-isooctyl ester, sodium salt<br>Agnique ® EHS 75E (Cognis) | 3 g |
| Conductive additive | Aqueous dispersion of a conductive polymer<br>Clevios ® P (H.C. Starck) | 0.6 g |
| Rheological modifier | Aqueous dispersion of acrylic copolymer<br>Sterocoll ® FD (BASF) | 0.6 g |
| Spreading agent | Non-ionic surfactant<br>Surfynol ® 420 (Safic-Alcan) | 0.2 g |

The printable layer C had a final concentration of 50% by weight and viscosity of 100 cps, as measured with the help of a Brookfield® viscosimeter.

The layer C was applied onto one face of a PET plastics film that had previously been covered in an anti-adhesive layer based on chromic chloride stearate. The layer C was deposited on the film at about 10 g/m$^2$. The layer C was then dried in an oven at 70° C. A multilayer structure was thus obtained constituted by the PET plastics film, an anti-adhesive layer of chromic chloride stearate, and the printable layer C.

The free face of the layer C, i.e. the face situated on its side opposite from the plastics film, was pasted with a Super-Lok® 364 adhesive from the supplier National Starch. The adhesive was deposited at 3 g/m$^2$ on the layer C. The pasted face of the layer C was applied against a substrate constituted by 335 g/m$^2$ Bristol® paper fabricated by the supplier Arjowiggins, and then the assembly was dried in an oven at 70° C.

The plastics film and the anti-adhesive layer were subsequently withdrawn in order to leave only the printable layer C and the adhesive on the paper substrate.

The resistivity of the paper as obtained in that way was relatively low, being of the order of $3\times10^7$. This resistivity is less than that of the paper of Example A which was of the order of $1\times10^{10}$ approximately.

EXAMPLE 6

Preparing a Smooth or Ultra-Smooth Sheet for Ink Jet Printing

A smooth or ultra-smooth sheet of the invention for ink jet printing was prepared from a printable layer D having the following composition:

| Compounds | | |
|---|---|---|
| Pigments | Alumina<br>Disperal HP14-2 (Sasol) | 1000 g |
| Binder | Polyvinyl alcohol<br>Mowiol 47-88 (Seppic) | 100 g |
| Spreading agent | Non-ionic surfactant<br>Surfynol ® CT211<br>(Safic-Alcan) | 1 g |

The printable layer D had a final concentration of 14% by weight and viscosity of 50 cps, as measured with the help of a Brookfield® viscosimeter.

The layer D was applied onto one face of a PET plastics film that had previously been covered in an anti-adhesive layer based on chromic chloride stearate. The layer D was deposited on the film at about 15 g/m$^2$. The layer D was then dried in an oven at 70° C. A multilayer structure was then obtained constituted by the PET plastics film, an anti-adhesive layer of chromic chloride stearate, and the printable layer D.

The free face of the layer D, i.e. the face situated on the side opposite from the plastics film, was pasted with a Super-Lok® 364 adhesive from the supplier National Starch. The adhesive was deposited at 3 g/m$^2$ on the layer D. The pasted face of the layer D was applied against a substrate formed by 335 g/m$^2$ Bristol® paper fabricated by the supplier Arjowiggins, and then the assembly was dried in an oven at 70° C.

The plastics film and the anti-adhesive layer were then withdrawn in order to leave only the printable layer D and the adhesive on the paper substrate.

Results: the various sheets prepared in Examples 1 to 6 were analyzed and the following parameters of each sheet were measured: grammage, thickness, bulk, smoothness, gloss, resistivity, and printability.

The measurements were performed as follows:

- grammage was measured using the ISO 536 (1976) standard, by means of Sartorius® scales having a maximum weight of 2220 grams (g) and with a precision of 0.1 g;
- the thickness was measured using the ISO 534 (1988) standard by means of an MTS MI20 micrometer;
- the bulk (or volume per unit weight) was measured using the NFQ 03-017 standard;
- the Bekk smoothness was measured using the ISO 5627 (1984) standard by means of a Büchel® 131 ED appliance;
- the gloss was measured at 75° using the TAPPI®T480 om-92 method by means of a Byk-Gardner® micro-gloss 75° model 4553 appliance;
- the surface resistivity was measured using the ASTM D257-83 method by means of a Philips PM2525 Multimeter appliance;
- the offset printability was evaluated by a porometric ink absorption test using a CTP No. 9 method; the "porometric ink" test serves to put a figure on the absorption capacity of a paper and on the penetration speed of the ink into the paper; it is based on depositing a special ink, formulated using a black dye, on the paper and on studying how it behaves over time; and the ink jet printing tests were performed with Epson 2400 and Canon ip 8500 ink jet printers.

The table below summarizes all of the measurements and analyses performed on the sheets of Examples 1 to 6.

It should also be observed that the greater the initial smoothness of the support, the greater the smoothness of the support onto which the layer A is transferred. The layer A transferred onto a Maine Gloss® paper enables that paper to be given very great smoothness of 9436 s.

| | | | | Examples | | | | | |
|---|---|---|---|---|---|---|---|---|---|
| Support | Bristol ® paper | Elementa ® bulk paper | Maine Gloss ® paper | Example 1: Layer A on Bristol ® | Example 2 Layer A Elementa ® bulk | Example 3: Layer A Maine Gloss ® | Example 4: Layer B on Bristol ® | Example 5: Layer C on Bristol ® | Example 6: Layer D on Bristol ® |
| Grammage (g/m$^2$) | 270 | 100 | 250 | 304 | 130 | 290 | 396 | 311 | 294 |
| Thickness (μm) | 250 | 140 | 220 | 273 | 173 | 240 | 310 | 314 | 334 |
| Bulk (cm$^3$/g) | 0.92593 | 1.4 | 0.88 | 0.9 | 1.33 | 0.83 | 0.78 | 1.01 | 1.14 |
| Bekk smoothness (s) | 60 | 20 | 400 | 7705 | 5035 | 9436 | 9532 | 6036 | 996 |
| Gloss (at 75°, in %) | x | x | x | 85.1 | 86.3 | 87 | 85.9 | 86.6 | 85.4 |
| Surface resisitivity | x | x | x | $9.72 \times 10^9$ | x | x | $2.47 \times 10^{10}$ | $3.48 \times 10^7$ | x |
| Porometric ink 15 s | x | x | x | V 0.36 | V 0.33 | V 0.34 | C 0.95 | V 0.37 | x |
| tests (optical 30 s | x | x | x | V 0.37 | V 0.30 | V 0.33 | C 1.22 | V 0.41 | x |
| density as a 60 s | x | x | x | V 0.37 | V 0.31 | V 0.34 | C 1.06 | V 0.40 | x |
| function of 120 s | x | x | x | V 0.38 | V 0.32 | V 0.35 | C 1.04 | V 0.46 | x |
| contact time) | | | | | | | | | |

(x: parameters not measured)

The transfer of a printable layer (A to D) onto a support increases the grammage and the thickness of the support. The increase in grammage is about 30 g/m$^2$ to 40 g/m$^2$ for layer A, 126 g/m$^2$ for layer B, 41 g/m$^2$ for layer C, and 24 g/m$^2$ for layer D. The increase in thickness is about 20 μm to 33 μm for layer A, 60 μm for layer B, 64 μm for layer C, and 84 μm for layer D. The increase in the grammage and the thickness of the support is due essentially to the addition of adhesive and to the transfer of the printable layer onto the support.

A paper is said to have relatively large bulk when the value of its bulk is greater than or equal to 1.10 cm$^3$/g. In the examples above, only the Elementa® bulk paper had large bulk (1.4 cm$^3$/g).

Depositing the printable layer A on a support reduces its bulk. When the support initially had large bulk, as with Elementa® bulk in Example 2, the transfer of the layer A onto the support gave rise to a small reduction in its bulk (about 5%). The bulk of the Elementa® bulk support having the layer A nevertheless remained very large (1.33 cm$^3$/g, i.e. greater than 1.10 cm$^3$/g).

Depositing the printable layer B on a support reduced its bulk, whereas depositing the printable layer C on a support had little influence on its bulk.

Depositing the printable D on a support increased its bulk since the printable layer is an ink jet layer that is very porous and thus of low density.

The Bristol® and Elementa® bulk papers initially had relatively poor smoothness, less than 100 s. By virtue of its precoating based on calcium carbonate and styrene butadiene latex, the precoated Maine Gloss® layer initially had relatively good smoothness of 400 s.

The transfer of a printable layer onto a support by means of the method of the invention serves to confer a smooth or ultra-smooth face to the support, as explained above.

The transfer of the printable layer A onto a paper support enables its smoothness to be increased considerably. It should be observed that the printable layer A enables a paper of large bulk to have very great smoothness (5035 s in Example 2) imparted thereto. The method of the invention thus makes it possible to provide paper that presents both bulk and smoothness that are large.

Transferring the layer D onto a Bristol® support enables its smoothness to be increased to about 1000 s.

The sheets prepared in Examples 1 to 6 all presented high gloss, greater than 80%. The method thus makes it possible to prepare sheets presenting both smoothness and gloss that are considerable.

The presence of a conductive additive in the layer C serves to reduce the surface resistivity of the sheet considerably. The sheet of Example 5 had surface resistivity that was less than that of the sheets of Examples 1 to 4 by a factor of about 1000. The additive serves to increase the electrical conductivity of the sheets, and thus makes it possible to envisage making electrically conductive sheets.

Concerning the offset printability of the sheets prepared in Examples 1 to 5, the test with porometric inks shows that the papers had relatively satisfactory optical density values after inking, even if density did not increase over time, thus showing that absorption was limited.

Concerning paper suitable for ink jet printing, as prepared in Example 6, the tests performed on Epson and Canon ink jet printers show results that are acceptable in spite of low deposition.

EXAMPLE 7

Preparing a Smooth or Ultra-Smooth Printable Sheet Including a Printable Resin or Varnish A smooth or ultra-smooth sheet of the invention was prepared from a printable layer formed by an acrylic printable resin or varnish E having the fowling composition. The sheet was suitable for offset printing.

| Composition of printable varnish E | | |
|---|---|---|
| Binder | Aqueous dispersion of n-butyl acrylate-acrylonitrile-styrene copolymer Acronal ® S305D (BASF) | 300 g |
| Dispersant | Sulfoccinic acid-isooctyl ester, sodium salt Agnique ® EHS 75E (Cognis) | 3 g |

-continued

| Composition of printable varnish E | | |
|---|---|---|
| Rheological modifier | Aqueous dispersion of acrylic copolymer Sterocoll ® FD (BASF) | 0.6 g |
| Spreading agent | Non-ionic surfactant Surfynol ® 420 (Safic-Alcan) | 0.2 g |

The printable varnish E had a final concentration of 50% by weight and viscosity of 50 cps, as measured with the help of a Brookfield® viscosimeter.

The varnish E was applied onto one face of a PET plastics film that had previously been covered in an anti-adhesive layer based on chromic chloride stearate. The varnish was deposited on the film at about 5 g/m$^2$. The varnish was then dried in an oven at 70° C. A multilayer structure was then obtained constituted by the PET plastics film, an anti-adhesive layer of chromic chloride stearate, and the acrylic varnish.

The free face of the varnish was pasted with a Super-Lok® 364 adhesive from the supplier National Starch. The adhesive was deposited at 3 g/m$^2$ onto the varnish. The pasted face of the varnish was applied against a substrate constituted by 335 g/m$^2$ Bristol® paper fabricated by the supplier Arjowiggins, and then the assembly was dried in an oven at 70° C. The plastics film and the anti-adhesive layer were then withdrawn (during step c)) in order to leave only the printable varnish and the adhesive on the paper substrate.

The table below summarizes the measurements and analyzes performed on the sheet prepared in Example 7.

| Support | Example 7: Printable varnish E on Bristol ® |
|---|---|
| Grammage (g/m$^2$) | 280 |
| Thickness (μm) | 260 |
| Bulk (cm$^3$/g) | 0.93 |
| Bekk smoothness (s) | >10,000 |
| Gloss (at 75°, in %) | 99 |

Transferring the printable varnish E onto the support produced little modification to the grammage, thickness, and bulk of the support. The transfer enabled a sheet to be prepared having smoothness (>10,000 s) and gloss (99%) that are very high. Nevertheless, the printability of the sheet was not as good as the printabilities of the sheets prepared in Examples 1 to 6 because of the absence of pigments in the printable layer.

EXAMPLE 8

Preparing Smooth or Ultra-Smooth Printable Sheets that are Suitable for Offset Printing, Indigo Printing, or Printing Using Electrically Conductive Inks In this example, each prepared sheet comprised two printable layers AA, AB, or AC, a first layer (A, B, or C) deposited (by kiss coating) on the anti-adhesive layer of the multilayer structure, and a second layer (A) deposited (by kiss coating) on the first layer. The first layer, i.e. the layer closer to the plastics film in the multilayer structure was the layer for directly receiving inks during printing. It is the layer that defines the printability depending on the printing method. The second layer was a precoating providing the first layer with good adhesion on the support and forming a barrier against the adhesive (to prevent the adhesive penetrating into the printable first layer).

The plastics film used was a PET film having a thickness of 12 μm. The printable layers for preparing an offset printable sheet were a first layer B and a second layer A. The printable layers for preparing a sheet suitable for HP indigo printing were a first layer C and a second layer A. The printable layers for preparing a sheet printable by electrically conductive inks (printed electronics) were a first layer A and a second layer A. The multilayer structures that were prepared were of the type comprising: PET/anti-adhesive layer/A&A or C&A or B&A layers. The layers A, B, and C were deposited at 6 g/m$^2$.

The compositions of those layers are set out in detail in the following tables.

| Composition of printable layer A | | |
|---|---|---|
| Pigments | Calcium carbonate Carbital ® 95 (Imerys) | 475 mL |
| Binder 1 | Aqueous dispersion of styrene-butadiene copolymer Styronal ® D517 (BASF) | 190 mL |
| Binder 2 | Aqueous dispersion of n-butyl acrylate-acrylonitrile-styrene copolymer Acronal ® S305 (BASF) | 94 mL |
| Dispersant | Sulfoccinic acid-isooctyl ester, sodium salt Agnique ® EHS 75E (Cognis) | 3 g |
| Rheological modifier | Aqueous dispersion of acrylic copolymer Sterocoll ® FD (BASF) | 0.6 g |
| Spreading agent | Non-ionic surfactant Surfynol® 420 (Safic-Alcan) | 0.2 g |

| Composition of printable layer B | | |
|---|---|---|
| Pigments | Calcium carbonate Carbital ® 95 (Imerys) | 475 mL |
| Binder 1 | Aqueous dispersion of styrene-butadiene copolymer Styronal ® D517 (BASF) | 95 mL |
| Binder 2 | Aqueous dispersion of n-butyl acrylate-acrylonitrile-styrene copolymer Acronal ® S305 (BASF) | 47 mL |
| Dispersant | Sulfoccinic acid-isooctyl ester, sodium salt Agnique ® EHS 75E (Cognis) | 3 g |
| Rheological modifier | Aqueous dispersion of acrylic copolymer Sterocoll ® FD (BASF) | 0.6 g |
| Spreading agent | Non-ionic surfactant Surfynol ® 420 (Safic-Alcan) | 0.2 g |

| Composition of printable layer C | | |
|---|---|---|
| Pigments | Calcium carbonate Carbital ® 95 (Imerys) | 475 mL |
| Binder 1 | Aqueous dispersion of styrene-butadiene copolymer Styronal ® D517 (BASF) | 95 mL |
| Binder 2 | Aqueous dispersion of n-butyl acrylate-acrylonitrile-styrene copolymer Acronal ® S305 (BASF) | 47 mL |
| Adhesion promoter | Aqueous dispersion of acrylic acid-ethylene Diamond ® 63001 (NALCO) | 280 ml |
| Dispersant | Sulfoccinic acid-isooctyl ester, sodium salt Agnique ® EHS 75E (Cognis) | 3 g |
| Rheological modifier | Aqueous dispersion of acrylic copolymer Sterocoll ® FD (BASF) | 0.6 g |
| Spreading agent | Non-ionic surfactant Surfynol ® 420 (Safic-Alcan) | 0.2 g |

Each of the three multilayer structures and 200 g/m$^2$ Opale® paper from the supplier Arjowiggins were coated in a two-component polyurethane adhesive at 10 g/m$^2$.

The resulting sheets presented good printability depending on their applications, i.e. for offset printing, for digital HP indigo printing, and for conductive inks (printed electronics).

The invention claimed is:

1. A method of fabricating a sheet which is printable by at least one of offset printing, ink jet printing, laser printing, photogravure, flexographic printing, dry toner, liquid toner, electrophotography, and lithography, presenting at least one smooth face, the sheet comprising a substrate having at least one face covered at least in part by a layer or a plurality of superposed layers, the method comprising the steps of:

a) preparing or providing a multilayer structure comprising at least a smooth plastics film, an anti-adhesive layer, and a printable layer, the anti-adhesive layer being interposed between the plastics film and the printable layer;

b) pasting adhesive on a face of the substrate or a face of the multilayer structure situated opposite from the plastics film, or both, and applying said face of the substrate against said face of the multilayer structure so as to laminate the multilayer structure and the substrate; and c) withdrawing the plastics film from the printable layer, the printable layer defining said smooth face of the sheet, wherein the printable layer comprises a mixture of pigments and binder, wherein a ratio of the binder to the pigments in the printable layer is 0.05 to 0.50 by dry weight, and wherein the sheet does not include a plastics film.

2. The method according to claim 1, wherein the printable layer is in a solid state or dry, or both, in step b) or step c) or both.

3. The method according to claim 1, wherein the substrate is selected from: paper; tracing paper; cardstock; and coated or precoated paper.

4. The method according to claim 3, wherein the paper has bulk greater than or equal to 1.10 cm$^3$/g.

5. The method according to claim 1, wherein, prior to step b), said face of the substrate is precoated with at least one smoothing layer including one or more thermoplastic polymers or a mixture of pigments and at least one binder.

6. The method according to claim 5, wherein, prior to step b), the precoated layer of the substrate is calendered in order to increase its smoothness.

7. The method according to claim 1, wherein the plastics film is a film selected from the group consisting of polyethylene terephthalate (PET); polyethylene (PE);

polypropylene (PP); polymer based on polylactic acid (PLA); and any polymer based on cellulose.

8. The method according to claim 1, wherein the anti-adhesive layer is based on: silicone(s); siloxane(s); polysiloxane(s) or derivatives thereof; Werner complex(es); or waxes of: polyethylene, propylene, polyurethane, polyamide, polytetrafluoroethylene, or a mixture thereof.

9. The method according to claim 1, wherein the anti-adhesive layer is withdrawn at least in part from the printable layer while withdrawing the plastics film in step c).

10. The method according to claim 1, wherein the anti-adhesive layer remains on the printable layer when the plastics film is withdrawn in step c).

11. The method according to claim 1, wherein the multilayer structure comprises at least one additional layer deposited on the printable layer on a side opposite from the plastics film, a free face of said additional layer or of an additional layer farthest from the plastics film being for pasting and applying against said face of the substrate during step b).

12. The method according to claim 1, which comprises an additional step of printing the sheet with an ink having electrical or optical properties or both.

13. The method according to claim 1, wherein the smooth face of the sheet has Bekk smoothness greater than about 900 s.

14. The method according to claim 1, wherein the smooth face of the sheet has gloss greater than 70%, when the gloss is measured at 75°.

15. The method according to claim 14, wherein said smooth face of the sheet has gloss greater than 80%, when the gloss is measured at 75°.

16. The method according to claim 1, wherein the printable layer has a thickness less than or equal to 30 μm, or grammage less than or equal to 30 g/m$^2$, or both.

17. The method according to claim 1, further comprising, before step a), a preliminary step of making indented or projecting patterns or both on the face of the plastics film that is to receive the anti-adhesive layer and the printable layer, the printable layer being for fitting closely to a shape of these patterns so as to include an imprint of said face of the plastics film.

18. The method according to claim 1, wherein the adhesive is deposited at least on one face of the substrate in step b), and wherein a thickness of the deposited layer of adhesive is not less than half the mean roughness of the face of the substrate.

19. The method according to claim 1, wherein said binder comprises acrylic polymer, polyurethane, polymethyl methacrylate, styrene butadiene, vinyl acetate, polyamide, nitrocellulose or any other cellulose, polyvinyl alcohol, starch, or a mixture thereof.

20. The method according to claim 1, wherein the ratio of the binder to the pigments in the printable layer is 0.08 to 0.25 by dry weight.

21. The method according to claim 1, wherein said smooth face of the sheet has Bekk smoothness of greater than about 5000 s.

22. The method according to claim 1, wherein said face of the substrate has Bekk smoothness of about 20 s to 400 s.

23. The method according to claim 1, wherein the binder is a water-soluble binder.

24. The method according to claim 1, wherein said face of the substrate has Bekk smoothness of about 20 s to 400 s, and said smooth face of the sheet has Bekk smoothness of greater than about 900 s.

25. The method according to claim 1, wherein said face of the substrate has Bekk smoothness of about 20 s to 400 s, and said smooth face of the sheet has Bekk smoothness of greater than about 5000 s.

26. A sheet, printable by at least one of offset printing, ink jet printing, laser printing, photogravure, flexographic printing, dry toner, liquid toner, electrophotography, and lithography, presenting at least one smooth face, the sheet comprising a substrate having at least one face covered at least in part by a layer or a plurality of superposed layers, including a printable or printed layer defining said smooth face, wherein the printable or printed layer comprises a mixture of pigments and binder, wherein said smooth face has Bekk smoothness greater than about 900 s, and wherein the sheet does not include a plastics film.

27. The sheet according to claim 26, wherein its smooth face has gloss greater than 70, when the gloss is measured at 75°.

28. The sheet according to claim 20, wherein said smooth face of the sheet has gloss greater than 80%, when the gloss is measured at 75°.

29. The sheet according to claim 26, wherein the printable or printed layer has thickness less than or equal to 30 μm, grammage less than or equal to 30 $g/m^2$, or both.

30. A component comprising a sheet according to claim 26 which is printed by means of an ink having at least one of (i) electrical and (ii) optical properties, wherein the component is at least one of (i) electronic and (ii) optical.

31. The sheet according to claim 26, wherein said smooth face has Bekk smoothness greater than about 5000 s.

32. A method of making an electronic or optical component or both, comprising using a sheet according to claim 26 for making the electronic or optical component or both, the sheet being printed by at least one of offset printing, ink jet printing, laser printing, photogravure, flexographic printing, dry toner, liquid toner, electrophotography, and lithography and by means of an ink having electrical and/or optical properties.

33. A method of any of (i) printing a photographic image, (ii) making packaging, and (iii) casting, comprising providing a sheet according to claim 26 and any of (i) printing the photographic image on the sheet by at least one of offset printing, ink jet printing, laser printing, photogravure, flexographic printing, dry toner, liquid toner, electrophotography, and lithography, (ii) making the packaging with the sheet, and (iii) using the sheet in a casting application.

* * * * *